US011776446B1

(12) United States Patent
Shi

(10) Patent No.: US 11,776,446 B1
(45) Date of Patent: Oct. 3, 2023

(54) DISPLAY PANEL

(71) Applicant: TCL China Star Optoelectronics Technology Co., Ltd., Shenzhen (CN)

(72) Inventor: Wenbo Shi, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/971,559

(22) Filed: Oct. 22, 2022

(30) Foreign Application Priority Data

Jul. 28, 2022 (CN) ..... 202210898528.X

(51) Int. Cl.
*G09G 3/20* (2006.01)

(52) U.S. Cl.
CPC ..... *G09G 3/20* (2013.01); *G09G 2300/0408* (2013.01); *G09G 2300/0413* (2013.01); *G09G 2310/08* (2013.01); *G09G 2320/043* (2013.01)

(58) Field of Classification Search
CPC ..... G09G 3/20; G09G 2300/0408; G09G 2300/0413; G09G 2310/08; G09G 2320/043
See application file for complete search history.

(56) References Cited

U.S. PATENT DOCUMENTS

2020/0243000 A1* 7/2020 Huang ..... G09G 3/2096
2020/0243008 A1* 7/2020 Lee ..... G09G 3/3258
2020/0243029 A1* 7/2020 Nagasawa ..... G09G 3/3688
2021/0082334 A1* 3/2021 Dai ..... G09G 3/2092

* cited by examiner

*Primary Examiner* — Sejoon Ahn
(74) *Attorney, Agent, or Firm* — Nathan & Associates; Menachem Nathan

(57) ABSTRACT

The present disclosure provides a display panel including a display GOA unit and a dummy GOA unit connected to the display GOA unit, a pull-down module of the display GOA unit receives a frame start signal and a pull-down module of the dummy GOA unit receives a control signal; within a frame duration, the frame start signal comprises one frame start pulse, and the control signal comprises a first pulse and a second pulse sequentially generated at intervals; a first pulse of a previous frame is generated between a last clock pulse of a previous frame and a frame start pulse of a next frame; a second pulse of the previous frame is generated between the last clock pulse of the previous frame and the frame start pulse of the next frame or in synchronization with the frame start pulse of the next frame.

19 Claims, 3 Drawing Sheets

DISPLAY PANEL

CROSS-REFERENCE TO RELATED APPLICATION

This application claims priority to and the benefit of Chinese Patent Application No. 202210898528.X, filed on Jul. 28, 2022, the entire content of which is hereby incorporated by reference.

FIELD OF INVENTION

The present disclosure relates to a field of display technology, in particular to a display panel.

BACKGROUND OF INVENTION

The display device has been widely used in various electronic products as a display part of an electronic apparatus, wherein a gate drive circuit is an important component of the display device. The gate drive circuit may also be referred to as a GOA (Gate Driver On Array) circuit, which is a technology for realizing a driving method for gate progressive scanning by fabricating a gate line scanning driving signal circuit on an array substrate using an array process of a thin film transistor display.

In this case, some GOA circuits include multi-stage cascaded active GOA units, which may also be referred to as an active gate drive circuit, and dummy GOA units, which may also be referred to as a dummy gate drive circuit; wherein the active GOA units are connected with the gate lines in the display area, and the dummy GOA units are not connected to the gate lines, so that the active GOA units and the dummy GOA units have different loads.

In general, the GOA circuit using stage transmission pull-down includes a dummy GOA unit, and the pull-down operation of the pull-down module in the dummy GOA unit is started by the STV (Start Voltage, frame start voltage) signal of the next frame, but there is no stage-transferred STV signal of the next frame for the dummy GOA unit. Therefore, in an actual product, the above design causes the Q point of the dummy GOA unit to be at a high potential for a long time, so that the TFT (Thin Film Transistor) connected to the Q point is subjected to stress for a longer time, resulting in a shorter lifetime of the dummy GOA unit than the lifetime of the active GOA unit.

SUMMARY OF INVENTION

The present disclosure provides a display panel to solve a technical problem that a dummy GOA unit has a shorter lifetime.

The present application provides a display panel including:

a display GOA unit and a dummy GOA unit connected to the display GOA unit, wherein a pull-down module of the display GOA unit is configured to receive a frame start signal, and a pull-down module of the dummy GOA unit is configured to receive a control signal; wherein, within a frame duration, the frame start signal comprises one frame start pulse, and the control signal comprises a first pulse and a second pulse sequentially generated at intervals; a first pulse of a current frame is generated between a last clock pulse of the current frame received by the display GOA unit and a frame start pulse of a next frame; a second pulse of the current frame is generated between the last clock pulse of the current frame received by the display GOA unit and the frame start pulse of the next frame or in synchronization with the frame start pulse of the next frame.

Alternatively, in some embodiments of the present disclosure, the dummy GOA unit includes:

a pull-up control module electrically connected to a first terminal and a second terminal of the display GOA unit and to a first node, wherein the pull-up control module is configured to pull up a potential of the first node under the control of the first terminal and the second terminal of the display GOA unit;

a pull-up module which is configured to receive a clock signal and is electrically connected to the first node and a first output terminal, wherein the pull-up module is configured to output the clock signal to the first output terminal under control of the first node;

the pull-down module of the dummy GOA unit which is configured to receive the control signal and a low level signal and is electrically connected to the first node and the first output terminal, and the pull-down module of the dummy GOA unit is configured to pull potentials of the first node and the first output terminal down to a potential of the low level signal under control of the control signal; and a pull-down holding module which is electrically connected to the first node and the first output terminal, wherein the pull-down holding module is configured to maintain the potentials of the first node and the first output terminal at the potential of the low level signal.

Alternatively, in some embodiments of the present disclosure, the pull-down module of the dummy GOA unit pulls the potentials of the first node and the first output terminal down to the potential of the low level signal under control of the first pulse.

Alternatively, in some embodiments of the present disclosure, the second pulse is between the first pulse of the previous frame and the frame start signal of the next frame, and the pull-down module of the dummy GOA unit resets the potentials of the first node and the first output terminal to the potential of the low level signal under control of the second pulse.

Alternatively, in some embodiments of the present disclosure, the second pulse of the current frame is generated between the first pulse of the current frame and the frame start pulse of the frame start signal of the next frame.

Alternatively, in some embodiments of the present disclosure, the dummy GOA unit further includes:

a pre-charging module which is configured to receive the control signal and the low level signal and is electrically connected to the first node, wherein the pre-charging module is configured to pull the potential of the first node down to the potential of the low level signal under the control of the control signal.

Alternatively, in some embodiments of the present disclosure, between the second pulse of the current frame and a second pulse of the next frame, a driving timing of the display panel includes:

a reset period during which the pull-down module of the dummy GOA unit resets the potentials of the first node and the first output terminal to the potential of the low level signal under control of the second pulse;

a pull-up output period during which the pull-up control module pulls up the potential of the first node under the control of the first terminal and the second terminal of the display GOA unit, wherein the pull-up module outputs the clock signal to the first output terminal under the control of the first node;

a pull-down period during which the pull-down module of the dummy GOA unit pulls down the potentials of the first node and the first output terminal to the potential of the low level signal under control of the first pulse; and a pull-down holding period during which the pull-down holding module maintains the potentials of the first node and the first output terminal at the potential of the low level signal under control of a switching low frequency control signal.

Alternatively, in some embodiments of the present disclosure, the driving timing of the display panel further includes:

a pulse interval period between the pull-up output period and the pull-down period.

Alternatively, in some embodiments of the present disclosure, within a same frame, a time interval between the first pulse and the last clock pulse received by the display GOA unit is greater than zero seconds and less than or equal to 2/(P×N) microseconds, where P is a refresh frequency of the display panel, N is a number of stages of the display GOA unit, and N is a positive integer..

Alternatively, in some embodiments of the present disclosure, within a same frame, a time interval between the second pulse of the current frame and the frame start signal of the next frame is greater than or equal to 1/(P×N) microseconds and less than or equal to 2/(P×N) microseconds, where P is a refresh frequency of the display panel, N is a number of stages of the display GOA unit, and N is a positive integer.

The present application further provides a display panel including: a display GOA unit and a dummy GOA unit connected to the display GOA unit, wherein a pull-down module of the display GOA unit is configured to receive a frame start signal, and a pull-down module of the dummy GOA unit is configured to receive a control signal; and wherein, within a frame duration, the frame start signal comprises one frame start pulse, and the control signal is generated between a last clock pulse of the current frame received by the display GOA unit and a frame start pulse of a next frame, and the pull-down module of the dummy GOA unit is configured to pull down potentials of a first node and a first output terminal of the dummy GOA unit under control of the control signal.

The present disclosure provides a display panel including a display GOA unit and a dummy GOA unit connected to the display GOA unit, wherein a pull-down module of the display GOA unit is configured to receive a frame start signal, and a pull-down module of the dummy GOA unit is configured to receive a control signal; wherein, within a frame duration, the frame start signal comprises one frame start pulse, and the control signal comprises a first pulse and a second pulse sequentially generated at intervals; a first pulse of a current frame is generated between a last clock pulse of the current frame received by the display GOA unit and a frame start pulse of a next frame; a second pulse of the current frame is generated between the last clock pulse of the current frame received by the display GOA unit and the frame start pulse of the next frame or in synchronization with the frame start pulse of the next frame. The pull-down module of the present disclosure pulls down the dummy GOA unit according to the control signal, and the pulse signal of the control signal is generated between the last clock pulse received by the display GOA unit of the current frame and the frame start signal of the next frame, so that the potential of the dummy GOA unit can be pulled down earlier, the time when the dummy GOA unit is at a high potential can be shortened, and thus the lifetime of the dummy GOA unit can be prolonged.

DESCRIPTION OF DRAWINGS

In order to more clearly explain the technical solutions in the embodiments of the present disclosure, the following will briefly introduce the drawings required in the description of the embodiments. Obviously, the drawings in the following description are only some embodiments of the present disclosure. For those skilled in the art, without paying any creative work, other drawings can be obtained based on these drawings.

DETAILED DESCRIPTION OF EMBODIMENTS

Technical solutions in embodiments of the present disclosure will be clearly and completely described below in conjunction with drawings in the embodiments of the present disclosure. Obviously, the described embodiments are only a part of embodiments of the present disclosure, rather than all the embodiments. Based on the embodiments in the present disclosure, all other embodiments obtained by those skilled in the art without creative work fall within the protection scope of the present disclosure.

In the description of the present application, it is to be understood that the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

The transistor used in all embodiments of the present application may be a thin film transistor or a field effect transistor or other device having the same characteristics. Since the source and drain of the transistor used herein are symmetrical, the source and drain thereof are interchangeable. In an embodiment of the present application, in order to distinguish the two electrodes of the transistor other than the gate electrode, one of the electrodes is referred to as a source and the other is referred to as a drain. In the figures, a middle terminal of a pull-down module is a gate, a signal input terminal is a source, and an output terminal is a drain. In addition, the transistors used in the embodiments of the present application may include a P-type transistor and/or an N-type transistor, wherein the P-type transistor is turned on when the gate is at a low level and turned off when the gate is at a high level, and the N-type transistor is turned on when the gate is at a high level and turned off when the gate is at a low level.

The present application provides a display panel, which will be described in detail below. It should be noted that the sequence of description of the following embodiments is not to be taken as limiting the preferred sequence of the embodiments of the present application.

Figure 1:
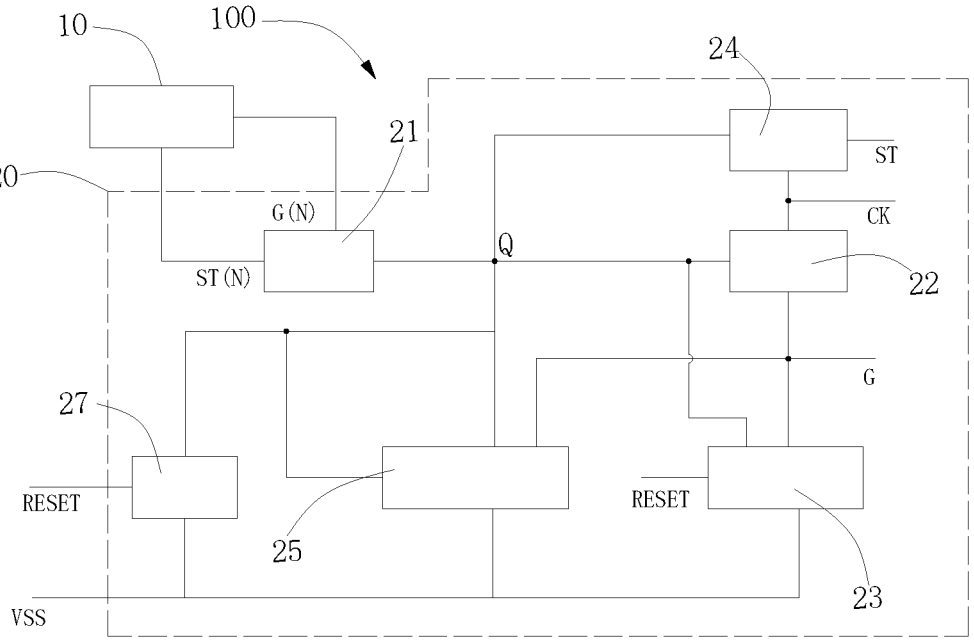
FIG. 1 is a schematic view of a first structure of a display panel according to the present application.
Figure 2:
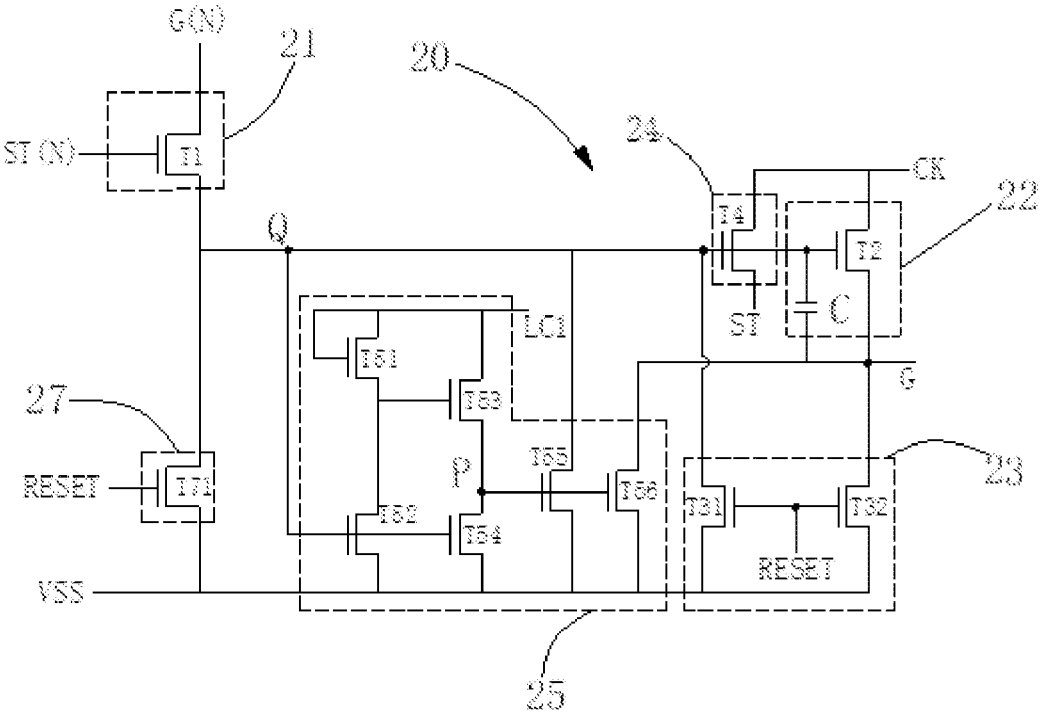
FIG. 2 is a schematic view of a first structure of a dummy GOA unit of the display panel according to the present application.
Figure 3:
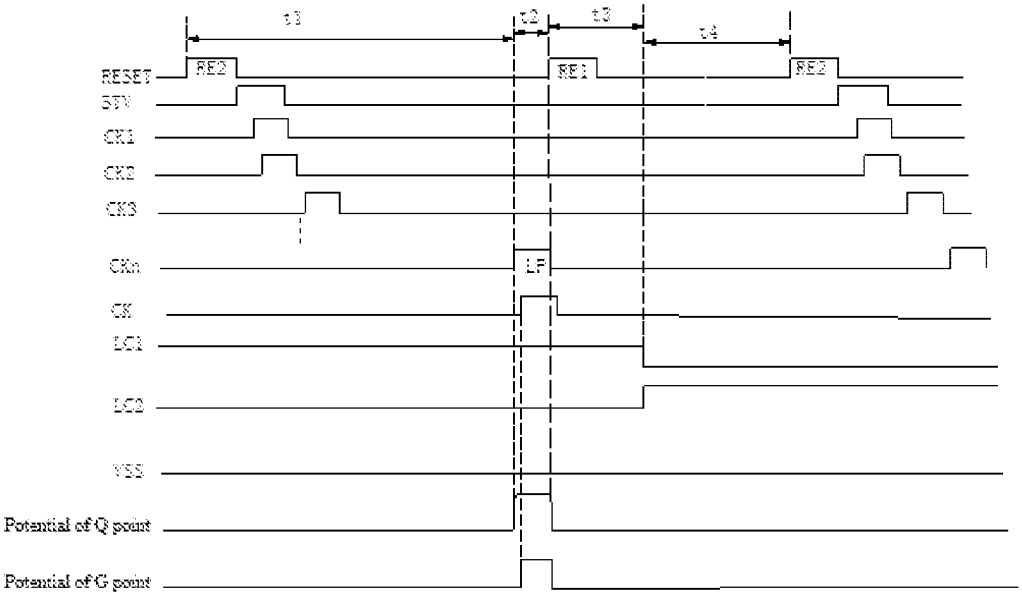
FIG. 3 is a schematic view of a first embodiment of signal timing of the dummy GOA unit of the display panel according to the present application.

Referring to FIGS. 1 to 3, FIG. 1 is a schematic view of a first structure of a display panel 100 according to the present application, FIG. 2 is a schematic view of a first structure of a dummy GOA unit 20 of the display panel 100 according to the present application, and FIG. 3 is a schematic view of a first embodiment of a signal timing of the dummy GOA unit of the display panel according to the present application. The present disclosure provides the display panel 100 including a display GOA unit 10 and the dummy GOA unit 20 connected to the display GOA unit 10.

A pull-down module of the display GOA unit 10 receives a frame start signal, and a pull-down module 23 of the dummy GOA unit 20 receives a control signal. Within a frame duration, the frame start signal STV includes one frame start pulse, and the control signal RESET includes a first pulse RE1 and a second pulse RE2 sequentially generated at intervals. The first pulse RE1 of a current frame is generated between a last clock pulse of the current frame received by the display GOA unit 10 and a frame start pulse of a next frame; the second pulse RE2 of the current frame is generated between the last clock pulse LP of the current frame received by the display GOA unit 10 and the frame start pulse of the next frame or in synchronization with the frame start pulse of the next frame.

The dummy GOA unit 20 includes a pull-up module 22, a pull-up control module 21, a pull-down module 23, and a pull-down holding module.

The pull-up control module 21 is electrically connected to first and second terminals of the display GOA unit 10 and to the first node Q. The pull-up control module 21 is configured to pull up the potential of the first node Q under the control of the electrical connection of the first and second terminals of the display GOA unit 10. The number of stages of the display GOA unit 10 is N, and N is a positive integer. Now, the display GOA units 10 cascaded in N stages are described as an example. At this time, the pull-up control module 21 is electrically connected to the first terminal and the second terminal of the display GOA unit 10 of the Nth stage. The first terminal of the display GOA unit 10 of the Nth stage outputs the stage transmission signal ST(N) of the display GOA unit 10, and the second terminal of the display GOA unit 10 of the Nth stage outputs the scanning signal G(N) of the display GOA unit 10.

The pull-up module 22 receives a clock signal CK and is electrically connected to the first node Q and the first output terminal G, and the pull-up module 22 is configured to output the clock signal CK to the first output terminal G under the control of the first node Q.

The pull-down module 23 of the dummy GOA unit of the dummy GOA unit 20 receives the control signal RESET and the low level signal VSS, and is electrically connected to the first node Q and the first output terminal G, the pull-down module 23 of the dummy GOA unit 20 is configured to pull down the potentials of the first node Q and the first output terminal G to the low level signal VSS under the control of the control signal RESET.

The pull-down holding module is electrically connected to the first node Q and the first output terminal G. The pull-down holding module is used for maintaining the potentials of the first node Q and the first output terminal G at the potential of the low level signal VSS. Specifically, the pull-down holding module receives the switching low frequency control signal and the low level signal VSS, and is electrically connected to the first node Q and the first output terminal G. After the pull-down module 23 of the dummy GOA unit 20 pulls down the potentials of the first node Q and the first output terminal G, the pull-down holding module is configured to maintain the potentials of the first node Q and the first output terminal G at the potential of the low level signal VSS under the control of the switching low frequency control signal.

In some embodiments, the pull-up control module 21 includes:

a first transistor T1, a gate of which is electrically connected to a first terminal of the display GOA unit 10, a source of the first transistor T1 is electrically connected to a second terminal of the display GOA unit 10, and a drain of the first transistor T1 is electrically connected to the first node Q.

In some embodiments, the pull-up module 22 includes:

a second transistor T2, a gate of the second transistor T2 is electrically connected to the first node Q, a source of the second transistor T2 receives the clock signal CK, and a drain of the second transistor T2 is electrically connected to the first output terminal G.

Further, in some embodiments, the pull-up module 22 further includes:

a bootstrap capacitor C having a first electrode electrically connected to the first node Q and a second electrode electrically connected to the first output terminal G.

In some embodiments, the pull-down module 23 of the dummy GOA unit 20 includes:

a third transistor T31, a gate of the third transistor T31 receives the control signal RESET, a source of the third transistor T31 is electrically connected to the first node Q, and a drain of the third transistor T31 receives the low level signal VSS; and a fourth transistor T32, a gate of the fourth transistor T32 receives the control signal RESET, a drain of the fourth transistor T32 receives the low level signal VSS, and a source of the fourth transistor T32 is electrically connected to the first output terminal G.

The dummy GOA unit 20 further includes:

a pre-charging module 27 which receives a control signal RESET and the low level signal VSS and is electrically connected to the first node Q, the pre-charging module 27 is configured to pull down the potential of the first node Q to the potential of the low level signal VSS under the control of the control signal RESET.

Further, in some embodiments, the pre-charging module 27 includes:

a fifth transistor T71, a gate of the fifth transistor T71 receives a control signal RESET, a drain of the fifth transistor T71 receives the low level signal VSS, a source of the fifth transistor T71 is electrically connected to the first node Q.

In the prior art, the frame start signal STV is used as a control signal to pull down the horizontal scanning signal line in the dummy GOA unit 20. Since the frame start signal STV is in the initial stage of one frame, after the frame start signal STV pulls down the horizontal scanning signal line in the dummy GOA unit 20, the signal of the horizontal scanning signal line in the dummy GOA unit 20 becomes a pull-up signal only when the scanning signal G(N) of the display GOA unit 10 and the stage transmission signal ST(N) of the display GOA unit 10 are applied to the dummy GOA unit 20. If the frame start signal STV is used as a control signal to pull down the horizontal scanning signal line in the dummy GOA unit 20, the horizontal scanning signal line in the dummy GOA unit 20 will be pulled down in the next frame, thus causing the horizontal scanning signal line in the dummy GOA unit 20 to be at a high potential for a longer time, which also leads to a short lifetime of the dummy GOA unit 20.

The pull-down module 23 of the present application pulls down the potential of the first output terminal G to the low level signal VSS under the control of the control signal RESET. Since the first pulse RE1 of the control signal RESET is generated between the last clock pulse LP received by the display GOA unit 10 in the current frame and the frame start signal STV of the next frame, the level of the first output terminal G can be pulled down to the low level signal VSS earlier, thereby reducing the time that the first output terminal Gin the dummy GOA unit 20 is in a high potential state and prolonging the lifetime of the dummy GOA unit 20. In addition, since the second pulse RE2 of the control signal RESET is generated between the last clock pulse LP received by the display GOA unit 10 in the current frame and the frame start signal STV of the next frame, the potential of the first output terminal G is pulled down to the low level signal VSS under the control of the control signal RESET before the start of the next frame, and the first output terminal G of the entire display panel 100 is reset, which can remove the residual potential of the first output terminal G and prolong the output accuracy of the first output terminal G of the dummy GOA unit 20.

In some embodiments, the dummy GOA unit 20 further includes:

a down transfer module 24 which receives the clock signal CK and is electrically connected to the first node Q and the second output terminal ST, the down transfer module 24 is configured to output the clock signal CK to the second output terminal ST under the control of the first node Q.

Further, the down transfer module 24 includes:

a sixth transistor T4, a gate of which is electrically connected to the first node Q, a source of which receives the clock signal CK, and a drain of which is electrically connected to the second output terminal ST.

In some embodiments, the pull-down holding module includes:

the first pull-down holding module 25, which receives the first switching low frequency control signal LC1 and the low level signal VSS, and is electrically connected to the first node Q and the first output terminal G. After the first node Q and the first output terminal G are pulled down by the pull-down module 23 of the dummy GOA unit 20, the first pull-down holding module 25 is used for maintaining the first node Q and the first output terminal G at the potential of the low level signal VSS under the control of the first switching low frequency control signal LC1.

Further, the first pull-down holding module 25 includes a seventh transistor T51, an eighth transistor T52, a ninth transistor T53, a tenth transistor T54, an eleventh transistor T55, and a twelfth transistor T56.

A gate and a source of the seventh transistor T51 both receive the first low frequency clock signal LC1, and a drain of the seventh transistor T51 is electrically connected to a drain of the eighth transistor T52. A gate of the eighth transistor T52 is electrically connected to the first node Q. A source of the eighth transistor T52 receives the low level signal VSS. A gate of the ninth transistor T53 is electrically connected to the drain of the eighth transistor T52, a source of the ninth transistor T53 receives the first low frequency clock signal LC1, and a drain of the ninth transistor T53 is electrically connected to the second node P. A gate of the tenth transistor T54 is electrically connected to the first node Q. A source of the tenth transistor T54 receives the low level signal VSS, and a drain of the tenth transistor T54 is electrically connected to the second node P.

A gate of the eleventh transistor T55 is electrically connected to the second node P, a source of the eleventh transistor T55 is electrically connected to the first node Q, and a drain of the eleventh transistor T55 receives the low level signal VSS.

A gate of the twelfth transistor T56 is electrically connected to the second node P, a source of the twelfth transistor T56 is electrically connected to the first output terminal G, and a drain of the twelfth transistor T56 receives the low level signal VSS.

Referring to FIG. 3, FIG. 3 is a schematic view of the first embodiment of the signal timing of the dummy GOA unit of the display panel according to the present disclosure. The control signal RESET includes the first pulse RE1 and the second pulse RE2, which are generated between the last clock pulse LP of the current frame received by the display GOA unit 10 and the frame start pulse of the frame start signal STV of the next frame, and the current frame is adjacent to the next frame. Specifically, the first pulse RE1 and the second pulse RE2 are generated between the clock pulse of the last clock pulse LP of the current frame received by the display GOA unit 10 and the frame start pulse of the frame start signal STV of the next frame. The clock signal CK is a high-frequency clock signal.

In the prior art, the frame start signal STV is used as a control signal to pull down the first node Q of the dummy GOA unit 20. Since the frame start signal STV is in the initial stage of one frame, after the frame start signal STV pulls down the first node Q of the dummy GOA unit 20, during the period from the scanning signal G(N) of the display GOA unit 10 of the Nth stage and the stage transmission signal ST(N) of the display GOA unit 10 of the Nth stage to the frame start signal STV in the next frame, the first node Q in the dummy GOA unit 20 is at a high potential, thus causing the first node Q to be at a high potential for a longer time, which leads a short lifetime of the dummy GOA unit 20.

In contrast, in the pull-down module 23 of the present disclosure, the control signal RESET is used as a control signal to pull down the first node Q of the dummy GOA unit 20. The control signal RESET is generated between the last clock pulse LP of the current frame received by the display GOA unit 10 and the frame start signal STV of the next frame. Therefore, the potential of the first node Q can be pulled down earlier to reduce the time when the first node Q is at a high potential, thus prolonging the lifetime of the dummy GOA unit 20.

It is to be noted that the scanning signal G(N) of the display GOA unit 10 of the Nth stage is output to the gate of the pixel TFTs of the display panel 100, and the first output terminal G of the dummy GOA unit 20 is not required to be connected to the gate of the pixel TFTs of the display panel 100.

In some embodiments, the pull-down module 23 of the dummy GOA unit 20 pulls the potentials of the first node Q and the first output terminal G down to the potential of the low level signal VSS under the control of the first pulse RE1.

In some embodiments, the pull-down module 23 of the dummy GOA unit 20 resets the potentials of the first node Q and the first output terminal G to the potential of the low level signal VSS under the control of the second pulse RE2. Further, the second pulse RE2 of the current frame is generated between the first pulse RE1 of the current frame and the frame start pulse of the frame start signal STV of the next frame.

Specifically, during the period from the second pulse RE2 of the current frame to the second pulse RE2 of the next frame, the driving timing of the display panel 100 includes:

a reset period t1, during which the pull-down module 23 of the dummy GOA unit 20 resets the potentials of the first node Q and the first output terminal G to the potential of the low level signal VSS under the control of the second pulse RE2;

a pull-up output period t2, during which the pull-up control module 21 is configured to pull up the potential of the first node Q under the control of the first terminal and the second terminal of the display GOA unit 10, and the pull-up module 22 outputs the clock signal to the first output terminal G under the control of the first node Q;

a pull-down period t3, during which the pull-down module 23 of the dummy GOA unit 20 pulls the potentials of the first node Q and the first output terminal G down to the potential of the low level signal VSS under the control of the first pulse RE1; and a pull-down holding period t4, during which the pull-down holding module maintains the potentials of the first node Q and the first output terminal G at the potential of the low level signal VSS under the control of the switching low frequency control signal.

As can be seen from the above, since the second pulse RE2 of the current frame is generated between the first pulse RE1 of the current frame and the frame start signal STV of the next frame, compared with the prior art, the potentials of the first node Q and the first output terminal G can be reset to the potential of the low level signal VSS earlier in the present disclosure, thereby stabilizing the voltages of the first node Q and the first output terminal G during the blanking time and reducing the voltage coupling fluctuation. In addition, the reset signal adopts a double-pulse mode, so that the introduction of signals can be reduced, which is beneficial to reduce wiring arrangement.

Figure 4:
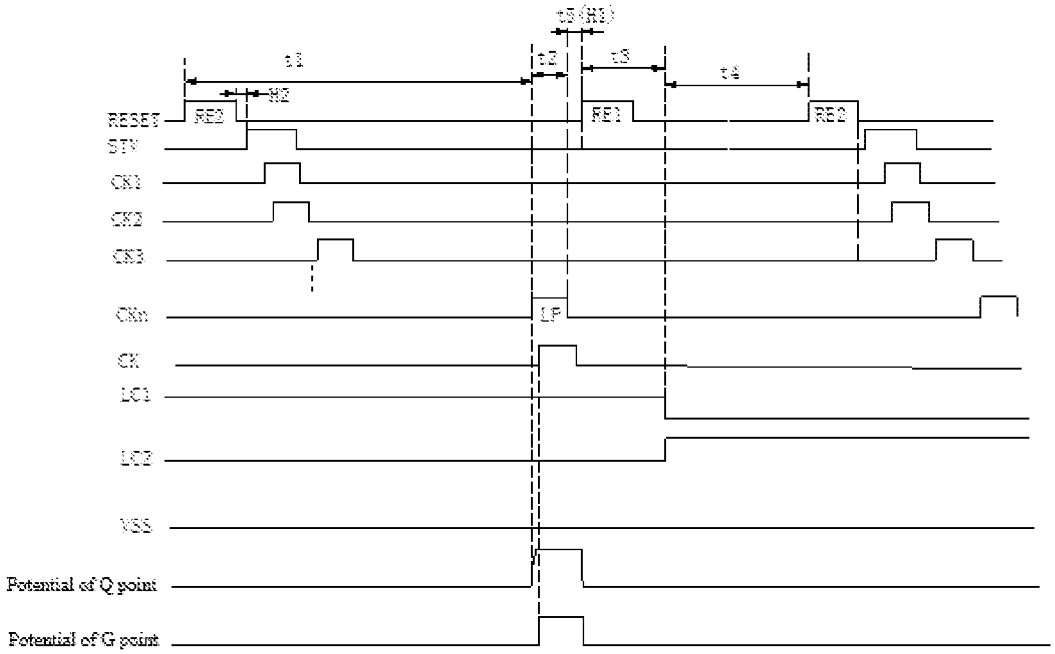
FIG. 4 is a schematic view of a second embodiment of signal timing of the dummy GOA unit of the display panel according to the present application.

Referring to FIG. 4, FIG. 4 is a schematic view of a second embodiment of the signal timing of the dummy GOA unit of the display panel of the present disclosure. In the present embodiment, during the period from the second pulse RE2 of the current frame to the second pulse RE2 of the next frame, the driving timing of the display panel includes:

a reset period t1, during which the pull-down module 23 of the dummy GOA unit 20 resets the potentials of the first node Q and the first output terminal G to the potential of the low level signal VSS under the control of the second pulse RE2;

a pull-up output period t2, during which the pull-up control module 21 is configured to pull up the potential of the first node Q under the control of the first terminal and the second terminal of the display GOA unit 10, and the pull-up module 22 outputs the clock signal to the first output terminal G under the control of the first node Q;

a pull-down period t3, during which the pull-down module 23 of the dummy GOA unit 20 pulls the potentials of the first node Q and the first output terminal G down to the potential of the low level signal VSS under the control of the first pulse RE1;

a pull-down holding period t4, during which the pull-down holding module maintains the potentials of the first node Q and the first output terminal G at the potential of the low level signal VSS under the control of the switching low frequency control signal; and a pulse interval period t5 located between the pull-up output period t2 and the pull-down period t3.

In some embodiments, the time interval H1 between the first pulse RE1 and the last clock pulse LP of the current frame received by the display GOA unit 1 0 in the same frame is greater than zero seconds and less than or equal to 2/(P×N) microseconds, where P is the refresh frequency of the display panel 100, N is the number of stages of the display GOA unit 10, and N is a positive integer. That is, the pulse interval period t5 includes a time interval Hl between the first pulse RE1 and the last clock pulse LP of the current frame received by the display GOA unit 10. After the output period is completed, the pulse interval period is followed by the pull-down period, so that the signal output of the output period can be stabilized.

That is, the display panel 100 includes N stages of display GOA units 10, wherein N is a positive integer. The time interval Hl between the first pulse RE1 and the last clock pulse LP of the Nth stage display GOA unit 10 is greater than zero seconds and less than or equal to 2/(P×N) microseconds. Therefore, after the pull-up control module 21 pulls up the potential of the first node Q under the control of the scanning signal G(N) of the Nth stage display GOA unit 10 and the stage transmission signal ST(N) of the Nth stage display GOA unit 10, in the range greater than 0 seconds and less than or equal to 2/(P×N) microseconds, the control signal RESET provides the first pulse RE1 to the pull-down module 23 of the dummy GOA unit 20, the pull-down module 23 of the dummy GOA unit 20 pulls down the potential of the first node Q of the dummy GOA unit 20 to the low level signal VSS, so that the time, when the first node Q is at a high potential, can be further reduced, and thus the lifetime of the dummy GOA unit 20 can be prolonged. Specifically, in an embodiment, the time interval between the first pulse RE1 and the last clock pulse LP of the Nth stage display GOA unit 10 is 1/(P×N) microseconds.

In some embodiments, the duration of the first pulse RE1 is 9/(P×N) microseconds. For example, 1/(P×N)=2.51 microseconds, then 9/(P×N)=22.59 microseconds, and the duration of the first pulse RE1 is 22.59 microseconds. In the same frame, the time interval between the first pulse RE1 and the last clock pulse LP of the Nth stage display GOA unit 10 ranges from 0 seconds to 5.02 microseconds.

In some embodiments, the time interval between the second pulse RE2 of the current frame and the frame start signal STV of the next frame is greater than or equal to 1/(P×N) microseconds and less than or equal to 2/(P×N) microseconds. A pulse interval is provided between the second pulse RE2 of the current frame and the frame start signal STV of the next frame, so that interference generated between the second pulse RE2 of the current frame and the frame start signal STV of the next frame can be avoided. The time interval between the second pulse RE2 of the current frame and the frame start signal STV of the next frame is 1/(P×N) microseconds.

Since the frame start signal STV of each frame is the boundary point between adjacent frames, the control signal RESET in the present disclosure outputs a second pulse RE2 before the next frame starts, and the pull-down module 23 of the dummy GOA unit 20 pulls down the potential of the first node Q of the dummy GOA unit 20 again to the low level signal VSS. That is, with respect to the frame start signal STV, the potential of the first node Q of the dummy GOA unit 20 in the present disclosure is pulled down again to the low level signal VSS before the next frame starts, which is beneficial for emptying the accumulated charge of the first node Q and can prevent excessive current caused by variable refresh rate frequency conversion.

In some embodiments, the duration of the second pulse RE2 is 9/(P×N) microseconds. For example, if 1/(P×N) =2.51 microseconds, then 9/(P×N)=22.59 microseconds, and the duration of the second pulse RE2 is 22.59 microseconds, the time interval between the second pulse RE2 of the current frame and the frame start signal STV of the next frame ranges from 2.51 microseconds to 5.02 microseconds.

Figure 5:
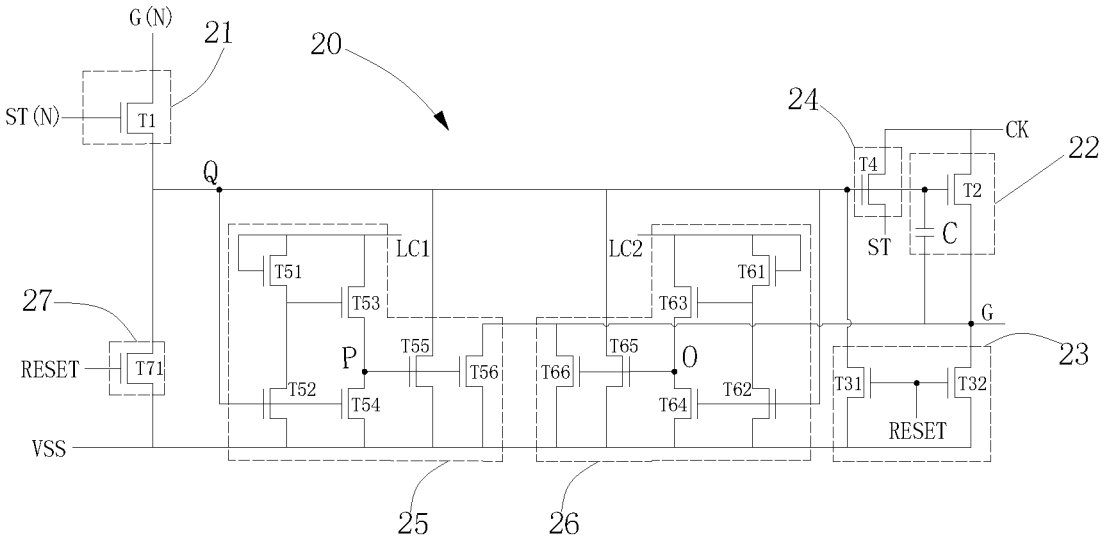
FIG. 5 is a schematic view of a second structure of the dummy GOA unit of the display panel according to the present application.

Referring to FIG. 5, FIG. 5 is a schematic view of a second structure of a dummy GOA unit 20 of a display panel 100 according to the present application. In the present embodiment, the pull-down holding module further includes:

the second pull-down holding module 26, which receives the second switching low frequency control signal LC2 and the low level signal VSS, and is electrically connected to the first node Q and the first output terminal G, after the pull-down module 23 of the dummy GOA unit 20 pulls down the potentials of the first node Q and the first output terminal G, the second pull-down holding module 26 is used for maintaining the potentials of the first node Q and the first output terminal G at the potential of the low level signal VSS under the control of the second switching low frequency control signal LC2.

Further, the second pull-down holding module 26 includes a thirteenth transistor T61, a fourteenth transistor T62, a fifteenth transistor T63, a sixteenth transistor T64, a seventeenth transistor T65, and an eighteenth transistor T66.

A gate and a source of the thirteenth transistor T61 both receive the second low frequency clock signal LC2, and a drain of the thirteenth transistor T61 is electrically connected to a drain of the fourteenth transistor T62. Agate of the fourteenth transistor T62 is electrically connected to the first node Q. A source of the fourteenth transistor T62 receives the low level signal VSS. A gate of the fifteenth transistor T63 is electrically connected to the drain of the fourteenth transistor T62, a source of the fifteenth transistor T63 receives the second low frequency clock signal LC2, and a drain of the fifteenth transistor T63 is electrically connected to the third node O. A gate of the sixteenth transistor T64 is electrically connected to the first node Q. A source of the sixteenth transistor T64 receives the low level signal VSS, and a drain of the sixteenth transistor T64 is electrically connected to the third node O.

A gate of the seventeenth transistor T65 is electrically connected to the third node O, a source of the seventeenth transistor T65 is electrically connected to the first node Q, and a drain of the seventeenth transistor T65 receives the low level signal VSS.

A gate of the eighteenth transistor T66 is electrically connected to the third node O, a source of the eighteenth transistor T66 is electrically connected to the first output terminal G, and a drain of the eighteenth transistor T66 receives the low level signal VSS.

Referring to FIGS. 3 and 4, the phase of the first low frequency clock signal LC1 is opposite to that of the second low frequency clock signal LC2.

A display panel provided by embodiments of the present disclosure are described in detail above. The principles and implementations of the present application are described in detail here with specific examples. The above description of the embodiments is merely intended to help understand the method and core ideas of the present application. At the same time, a person skilled in the art may make changes in the specific embodiments and application scope according to the idea of the present application. In conclusion, the content of the present specification should not be construed as a limitation to the present application.

What is claimed is:

1. A display panel comprising a display GOA unit and a dummy GOA unit, wherein the dummy GOA is connected to the display GOA unit, wherein the display GOA unit comprises a pull-down module, and the pull-down module of the display GOA unit is configured to receive a frame start signal, wherein the dummy GOA unit comprises a pull-down module, and the pull-down module of the dummy GOA unit is configured to receive a control signal, and wherein, within a frame duration, the frame start signal comprises one frame start pulse, and the control signal comprises a first pulse and a second pulse sequentially generated at intervals; a first pulse of a current frame is generated between a last clock pulse of the current frame received by the display GOA unit and a frame start pulse of a next frame; a second pulse of the current frame is generated between the last clock pulse of the current frame received by the display GOA unit and the frame start pulse of the next frame or in synchronization with the frame start pulse of the next frame.

2. The display panel according to claim 1, wherein the pull-down module of the dummy GOA unit further receives a low level signal and is electrically connected to a first node and a first output terminal of the dummy GOA unit, and the pull-down module of the dummy GOA unit is configured to pull potentials of the first node and the first output terminal down to a potential of the low level signal under control of the control signal.

3. The display panel according to claim 2, wherein the dummy GOA unit comprises:

a pull-up control module electrically connected to a first terminal and a second terminal of the display GOA unit and to the first node, wherein the pull-up control module is configured to pull up a potential of the first node under control of the first terminal and the second terminal of the display GOA unit;

a pull-up module configured to receive a clock signal and electrically connected to the first node and the first output terminal, wherein the pull-up module is configured to output the clock signal to the first output terminal under control of the first node; and a pull-down holding module electrically connected to the first node and the first output terminal, wherein the pull-down holding module is configured to maintain the potentials of the first node and the first output terminal at the potential of the low level signal.

4. The display panel according to claim 2, wherein the pull-down module of the dummy GOA unit pulls the potentials of the first node and the first output terminal down to the potential of the low level signal under control of the first pulse.

5. The display panel according to claim 2, wherein the pull-down module of the dummy GOA unit resets the potentials of the first node and the first output terminal to the potential of the low level signal under control of the second pulse.

6. The display panel according to claim 1, wherein the second pulse of the current frame is generated between the first pulse of the current frame and the frame start pulse of the frame start signal of the next frame.

7. The display panel according to claim 3, wherein the dummy GOA unit further comprises:

a pre-charging module configured to receive the control signal and the low level signal and electrically connected to the first node, wherein the pre-charging module is configured to pull the potential of the first node down to the potential of the low level signal under the control of the control signal.

8. The display panel according to claim 3, wherein, between the second pulse of the current frame and a second pulse of the next frame, a driving timing of the display panel comprises:

a reset period, during which the pull-down module of the dummy GOA unit resets the potentials of the first node and the first output terminal to the potential of the low level signal under control of the second pulse;

a pull-up output period, during which the pull-up control module pulls up the potential of the first node under the control of the first terminal and the second terminal of the display GOA unit, wherein the pull-up module outputs the clock signal to the first output terminal under the control of the first node;

a pull-down period, during which the pull-down module of the dummy GOA unit pulls down the potentials of the first node and the first output terminal to the potential of the low level signal under control of the first pulse; and a pull-down holding period, during which the pull-down holding module maintains the potentials of the first node and the first output terminal at the potential of the low level signal under control of a switching low frequency control signal.

9. The display panel according to claim 8, wherein the driving timing of the display panel further comprises a pulse interval period between the pull-up output period and the pull-down period.

10. The display panel according to claim 6, wherein, within the same frame, a time interval between the first pulse and the last clock pulse received by the display GOA unit is greater than zero seconds and less than or equal to 2/(P×N) microseconds, where P is a refresh frequency of the display panel, N is a number of stages of the display GOA unit, and N is a positive integer.

11. The display panel according to claim 6, wherein, within a same frame, a time interval between the second pulse of the control signal and the frame start signal is greater than or equal to 1/(P×N) microseconds and less than or equal to 2/(P×N) microseconds, where P is a refresh frequency of the display panel, N is a number of stages of the display GOA unit, and N is a positive integer.

12. A display panel comprising a display GOA unit and a dummy GOA unit, wherein the dummy GOA unit is connected to the display GOA unit, wherein the display GOA unit comprises a pull-down module, and the pull-down module of the display GOA unit is configured to receive a frame start signal, wherein the dummy GOA unit comprises a pull-down module, and the pull-down module of the dummy GOA unit is configured to receive a control signal; and wherein, within a frame duration, the frame start signal comprises one frame start pulse, and a pulse signal of the control signal is generated between a last clock pulse of a current frame received by the display GOA unit and a frame start pulse of a next frame, and the pull-down module of the dummy GOA unit is configured to pull down potentials of a first node and a first output terminal of the dummy GOA unit under control of the control signal.

13. The display panel according to claim 12, wherein the pulse signal of the control signal comprises a first pulse and a second pulse sequentially generated at intervals; a first pulse of the current frame is generated between a last clock pulse of the current frame received by the display GOA unit and a frame start pulse of a next frame; a second pulse of the current frame is generated between the first pulse of the current frame and the frame start pulse of the next frame or in synchronization with the frame start pulse of the next frame.

14. The display panel according to claim 13, wherein the pull-down module of the dummy GOA unit further receives a low level signal and is electrically connected to the first node and the first output terminal of the dummy GOA unit, and the pull-down module of the dummy GOA unit is configured to pull potentials of the first node and the first output terminal down to a potential of the low level signal under control of the first pulse and the second pulse.

15. The display panel according to claim 14, wherein within the same frame, the first pulse of the control signal and the last clock pulse received by the display GOA unit are separated by a first predetermined time interval.

16. The display panel according to claim 15, wherein the second pulse of the current frame and the frame start signal of the next frame are separated by a second predetermined time interval.

17. The display panel according to claim 14, wherein the pull-down module of the dummy GOA unit comprises a first transistor and a second transistor, gates of the first transistor and the second transistor both receive the control signal, and a source of the first transistor is electrically connected to the first node, a source of the second transistor is electrically connected to the first output terminal, and drains of the first transistor and the second transistor both receive the low level signal.

18. The display panel according to claim 14, wherein the dummy GOA unit comprises:

a pull-up control module electrically connected to a first terminal and a second terminal of the display GOA unit and electrically connected to the first node, wherein the pull-up control module is configured to pull up a potential of the first node under control of the first terminal and the second terminal of the display GOA unit;

a pull-up module configured to receive a clock signal and electrically connected to the first node and the first output terminal, wherein the pull-up module is configured to output the clock signal to the first output terminal under control of the first node;

a first pull-down holding module electrically connected to the first node and the first output terminal, wherein the first pull-down holding module is configured to maintain the potentials of the first node and the first output terminal at the potential of the low level signal under control of a first switching low frequency control signal; and a pre-charging module configured to receive the control signal and the low level signal and electrically connected to the first node, wherein the pre-charging module is configured to pull the potential of the first node down to the potential of the low level signal under the control of the control signal.

19. The display panel according to claim 18, wherein the dummy GOA unit further comprises a second pull-down holding module electrically connected to the first node and the first output terminal, the second pull-down holding module is configured to maintain the potentials of the first node and the first output terminal at the potential of the low level signal under control of a second switching low frequency control signal, and a phase of the first low frequency clock signal is opposite to that of the second low frequency clock signal.

* * * * *